United States Patent [19]

Brow

[11] Patent Number: 4,606,777

[45] Date of Patent: Aug. 19, 1986

[54] PAINT ROLLER CLEANER

[76] Inventor: Donald Brow, 12 Hewett Avenue, Hawthorndene, Australia, 5051

[21] Appl. No.: 487,276

[22] Filed: Apr. 21, 1983

[51] Int. Cl.[4] ..... B08B 3/02; B08B 3/04; B08B 7/00

[52] U.S. Cl. ..... 134/38; 15/104.04; 15/104.92; 68/213; 134/34; 134/138; 134/199

[58] Field of Search ..... 134/33, 34, 38, 138, 134/139, 100, 101, 172, 199; 68/213; 118/203; 239/543, 544, 545, 598; 15/104.04, 104.92

[56] References Cited

U.S. PATENT DOCUMENTS

| | | | |
|---|---|---|---|
| 1,357,730 | 11/1920 | Schaeffer | 134/38 |
| 2,222,516 | 11/1940 | Powell et al. | 134/101 |
| 2,616,437 | 11/1952 | Secor | 134/199 |
| 2,985,178 | 5/1961 | Christensen, Jr. | 134/149 |
| 3,045,931 | 7/1962 | Hall | 239/598 |
| 3,421,527 | 1/1969 | Dettman | 134/199 |
| 3,577,280 | 5/1971 | George | 134/138 |
| 4,126,484 | 11/1978 | Monteiro | 134/38 |
| 4,155,230 | 5/1979 | Lacher, Jr. | 68/213 |
| 4,377,175 | 3/1983 | Fritz | 68/213 |
| 4,517,699 | 5/1985 | Petricka | 15/104.04 |

OTHER PUBLICATIONS

Engineering Drawing of Paint Roller Washer Assembly-Item T11551 of World Tech Newsline, vol. 5, No. 39, Apr./May 1981.

*Primary Examiner*—S. Leon Bashore
*Assistant Examiner*—K. M. Hastings
*Attorney, Agent, or Firm*—Cushman, Darby & Cushman

[57] ABSTRACT

A paint roller cleaning device comprising an annular sleeve adapted to have an interference fit with a pad on a roller of a paint roller, liquid passage means within the sleeve, liquid entry means to said liquid passage means and liquid outlet means communicating with the liquid passage means on the inner surface of the annular sleeve.

10 Claims, 7 Drawing Figures

PAINT ROLLER CLEANER

This invention relates to a device for cleaning applicators and more particularly for cleaning roller type applicators.

For instance the use of roller applicators for applying paint is very popular as an even coating with a good finish is obtained but there is a problem that paint rollers are difficult to clean and hence in many cases this means that rollers are only used a few times and then disposed of whereas with efficient cleaning they may be cleaned and used many times. This problem applies to both rollers used for water based paints and for paints with solvent bases other than water.

A roller after being used may be swilled in a large excess of cleaning fluid but this will remove surface paint on the roller pad but will not efficiently remove paint or other deposits deep down in the pad.

This deep down paint or deposit if allowed to remain in the pad may harden and significantly reduce the life and efficiency of the paint roller.

It is an object therefore of this invention to provide a cleaning device for a paint roller which will alleviate one or both of the problems mentioned above.

Rollers, too, are used for other applications such as glue or ink or dampening rollers on printing presses. Cleaning of all these is time consuming and hence it is a further obJect of this invention to provide means to facilitate the cleaning of roller applicators in general.

The invention is therefore said to reside in a roller cleaning device comprising an annular sleeve adapted to have an interference fit with a pad on a roller of a paint roller, liquid passage means within the sleeve, liquid entry means to said liquid passage means, and liquid outlet means communicating with the liquid passage means on the inner surface of the annular sleeve.

In one preferred embodiment the liquid outlet means comprises a plurality of apertures whereby to provide a plurality of impingement jets onto the pad of the paint roller.

In another preferred embodiment the liquid outlet means comprises a slot completely around the circumference of the inner surface of the annular sleeve whereby a continuous impingement jet is provided against the pad of the paint roller.

The liquid entry means may include an internally screw threaded portion such that the device may be mounted onto a hose or tap.

There may be also included a handle on the roller cleaning device so that it may be easily used when connected to a hose.

With somc types of paint it is found advantageous to supply detergent along with the cleaning fluid to assist with the cleaning of the paint roller and in one embodiment of this invention there may be included detergent dispensing means.

In one embodiment of the detergent dispensing means the dispensing means may comprise of a receptacle on the sleeve, the receptacle having a sealable aperture whereby to insert detergent and at least one aperture communicating with the liquid passage means.

In another embodiment the detergent dispensing means may be incorporated into the handle of the paint roller cleaning device and suitable means may be provided to insert detergent into the handle.

The detergent envisaged here may be a liquid detergent or it may be detergent pellets.

To more clearly define the invention however reference will be made to the accompanying illustrations in which.

Figure 1:
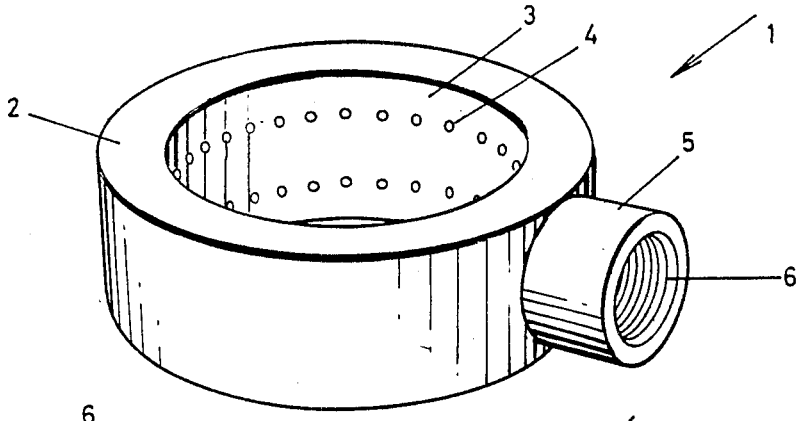
FIG. 1 shows one embodiment of a paint roller cleaning device according to this invention.

Now looking more closely at the drawings FIG. 1 shows a paint roller cleaning device 1 having an annular sleeve 2. Inside the annular sleeve on the inner surface 3 are a plurality of small apertures 4. A liquid inlet means 5 is included on the outside of the sleeve and incorporates a screw thread 6 such that the liquid cleaning device can be mounted on a tap.

Figure 2:
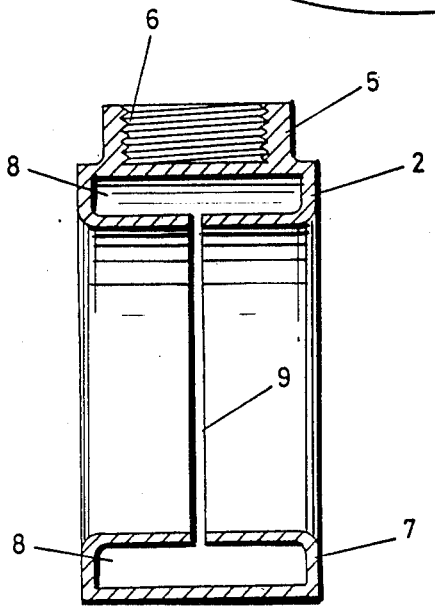
FIG. 2 shows a cross section of an alternative embodiment of a paint roller cleaning device.

FIG. 2 shows an alternative embodiment of the paint roller cleaning device in cross section in which the sleeve 2 comprises a wall section 7 and an annular hollow portion 8. Around the inner circumference 2 is a fine continuous slot 9.

Hence water entering the inlet means 5 will pass into the annular space 8 and be directed into the central space of the annular portion 2 through the slot 9.

Figure 3:
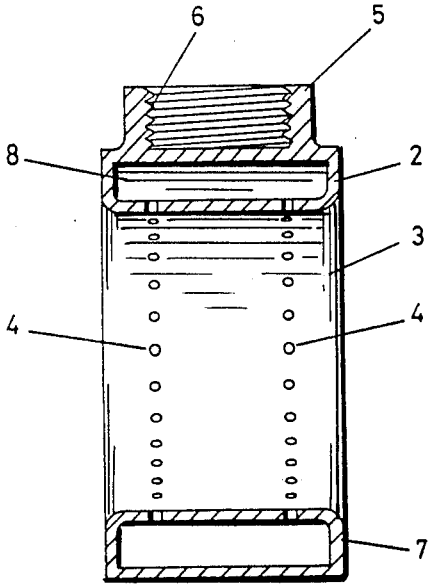
FIG. 3 shows a cross sectional view of the paint roller cleaning device of FIG. 1.

FIG. 3 shows a cross section of the embodiment of FIG. 1 and it will be seen that there is provided two rows of apertures 4 and the spacing of these apertures may be staggered to provide a good coverage over the whole of the surface of the paint roller being passed through the cleaning device.

Figure 4:
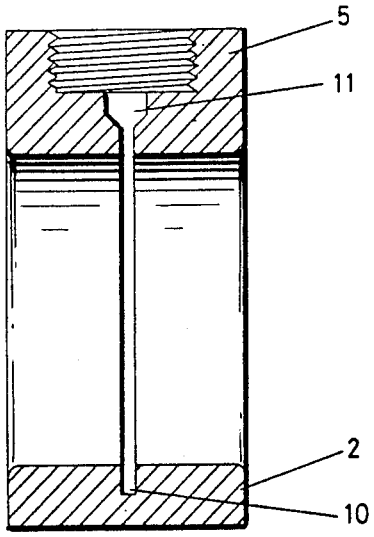
FIG. 4 shows an alternative embodiment of a paint roller cleaning device.

FIG. 4 shows an alternative simpler embodiment in which the annular sleeve 2 is solid and a slot 10 is cut around the inner circumference and it communicates with the liquid entry portion 5 by means of a drilling 11. This embodiment does not require complicated machining and may be machined directly from a solid piece of suitable material.

Figure 5:
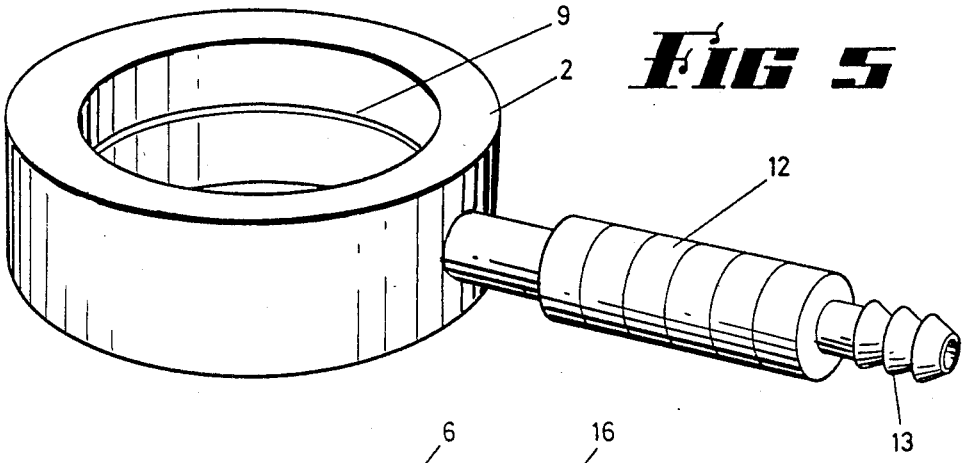
FIG. 5 shows a further preferred embodiment of a paint roller cleaning device.

FIG. 5 shows a similar roller cleaner device to that shown in FIG. 2 but it includes a handle 12 connected to the annular body of the paint roller cleaner and in this embodiment the handle 12 terminates in a hose adaptor 13.

Alternative ends to the handle 12 may be provided for connecting to screw threaded adaptors on hoses and to taps.

The handle 12 may have a bend along its length to make it more easy to be manipulated.

Figure 6:
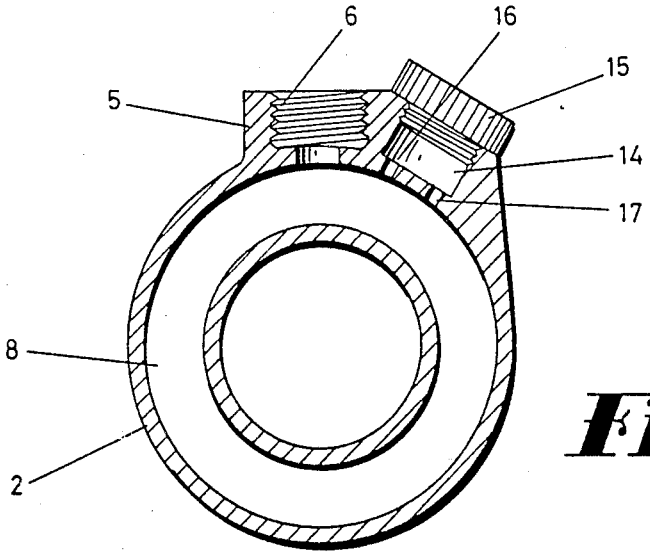
FIG. 6 shows a cross sectional view of a paint roller cleaning device incorporating a detergent dispensing receptacle and FIG. 7 shows a paint roller cleaning device in use.

FIG. 6 shows a cross sectional embodiment incorporating a detergent dispenser means. The detergent dispensing receptacle 14 includes a screw threaded cap 15 which seals the receptacle 14. An inlet aperture 16 and an outlet aperture 17 are provided between the annular space 8 and the receptacle 14.

In use a portion of detergent whether it be a liquid or so1id is placed within the receptacle 14 and the screw cap 15 placed in position. As water enters the annular space 8 it will pass through the aperture 16 into the receptacle and out again into the aperture 17 taking with it some detergent which will assist in the cleaning of the roller.

Figure 7:
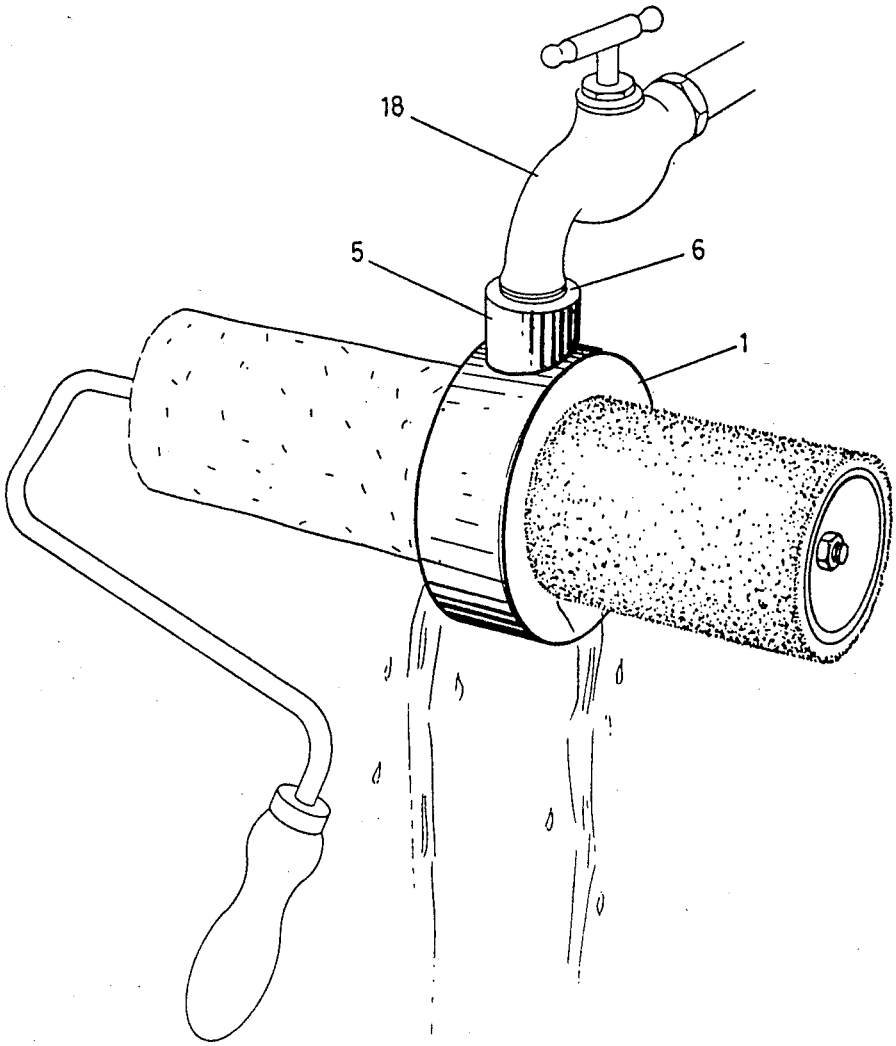

FIG. 7 shows the paint roller cleaning device in use. The paint roller device 1 is screwed onto a tap 18 by means of.the screw thread 6 in the attachment portion 5. The tap is turned on and the roller inserted into the aperture in the cleaning device and then the roller is slid from end to end so that water from the aperture or slot in the internal surface of the cleaning device will impinge upon the pad and flush out paint from the full depth of the pad.

The material of construction of the roller cleaning device may be metal or it may be of moulded or machined plastics materials.

It will be realised of course when the cleaning device is intended to be used for solvent based paints then a suitable plastics material which has resistance to solvents should be used.

Various size rollers are available and hence this invention envisages a range of size cleaning devices for various types and sizes of rollers.

It will be seen from the above therefore that by using an annular sleeve fitting with an interference fit around the cylindrical shape of a pad of a paint roller in effect limits egress of cleaning liquid from the liquid outlet means so that the cleaning fluid for instance water is forced more effectively to enter deep within the porous structure of the pad and hence cause a much more effective cleaning action.

The invention can however reside in the method of cleaning the pad of a roller useful for a paint roller which includes the steps of locating the pad with an interference fit within the annular sleeve of a paint roller cleaning device as described and then causing a cleaning fluid at pressure to eject through the liquid outlet means through the inner surface of the annular sleeve.

I claim:

1. A one piece cleaning device for a roller applicator of the type which includes a cylindrical core carrying an external pad of porous material, said pad having an outer diameter, said cleaning device comprising a hollow annular sleeve within the sleeve between the inside and outside surfaces thereof having inner and outer surfaces and open at both ends, and having an inside surface the diameter of which is substantially equal to the outside diameter of the pad of the roller applicator to be cleaned so as to provide an interference fit between the pad and the inside surface of said sleeve, annular liquid passage means within the sleeve between the inner and outer surfaces thereof, liquid entry means to said liquid passage means and liquid outlet means communicating with the liquid passage means and disposed on the inner surface of the annular sleeve making contact with the pad of the paint roller applicator whereby liquid emerging from said liquid outlet means is forced to enter deep within the porous material of the pad when the roller applicator is slid in an axial direction through said sleeve.

2. A paint roller cleaning device as in claim 1 wherein the liquid outlet means comprise a plurality of apertures whereby to provide in use a plurality of impingement jets.

3. A paint roller cleaning device as in claim 1 wherein the liquid outlet means comprises a slot completely around the circumference of the inner surface of the annular sleeve whereby to provide in use a continuous impingement jet.

4. A device as in claim 1, wherein the liquid entry means includes a screw thread whereby the device may be mounted onto a tap.

5. A device as in claim 4 wherein the liquid entry means further includes a handle.

6. A paint roller cleaning device as in claim 1 further including detergent dispensing means attached to said device for dispensing detergent into said liquid passage.

7. A paint roller cleaning device as in claim 6 wherein the detergent dispensing meas comprises a receptacle on the sleeve, the receptacle having a sealable aperture whereby to insert detergent and at least one aperture communicating with a liquid passage means.

8. A paint roller cleaning device as in claim 5 wherein a detergent dispensing means is incorporated into the handle.

9. A cleaning device for a roller applicator of the type which includes a cylindrical core carrying an external pad of porous material having an outside diameter, said cleaning device comprising a one-piece annular sleeve open at both ends and having a generally cylindrical inside surface, an outside surface, an internal annular passage and an integral connection projecting radially from said outside surface for supplying cleaning liquid to said passage, the axial length of said sleeve being substantially less than the length of the roller applicator, said inside surface having at least one liquid outlet means therein, the diameter of said inside surface being substantially equal to and slightly less than the outside diameter of the pad of the roller applicator to be cleaned so that upon axial insertion of the roller applicator into said sleeve, the pad of the roller applicator contacts said outlet means and said generally cylindrical inside surface of said sleeve, whereby liquid emerging from said liquid outlet means is forced to enter deep within the porous material of the pad when the roller applicator is slid in an axial direction through said sleeve.

10. A method of cleaning a roller applicator of the type including a cylindrical core carrying an external pad of porous material, said method comprising passing the roller applicator axially through a hollow annular cleaning sleeve of substantially less axial length than said roller applicator, said cleaning sleeve having an inside and an outside surface, at least one liquid outlet opening in said inside surface and annular passage means of substantially less axial length than said roller applicator and for supplying liquid to said outlet opening, said pad contacting said inside surface and said outlet opening so that liquid emerging from said outlet opening is forced to enter deep within the porous material of the pad as said roller applicator is moved axially through said cleaning sleeve.

* * * * *